United States Patent [19]

Chin-Hsiang

[11] Patent Number: 4,785,198

[45] Date of Patent: Nov. 15, 1988

[54] STRUCTURE OF FIXED DEVICE OF FAN SWITCH

[76] Inventor: Hsu Chin-Hsiang, 91, Lane 211, Chung Yiang Rd., Chung Ho Tsun, Long Chin Hsian, Taichung Hsien, Taiwan

[21] Appl. No.: 157,885

[22] Filed: Feb. 19, 1988

[51] Int. Cl.[4] ..... H01H 9/00

[52] U.S. Cl. ..... 307/154; 417/234; 415/121 G; 200/81.9 R; 307/112; 98/94.1

[58] Field of Search ..... 307/154, 112; 416/100, 416/110, 118, 170 R, 218, 204 R, 247 R; 417/423 G, 423 T, 423 R, 411, 424, 313, 234; 415/121 G, 182, 210, 146, 150, 125, 126; 98/94.1, 39.1, 101, 103, 22, 24, 121, 116, 120, 40.3; 310/62, 63, 40 MM, 43; 318/282, 286, 281, 256, 283, 285, 471, 472; 200/81.9 R

[56] References Cited

U.S. PATENT DOCUMENTS

| | | | |
|---|---|---|---|
| 2,755,015 | 7/1956 | Douglas et al. | 417/234 |
| 4,486,144 | 12/1984 | Hung | 415/121 G |
| 4,725,700 | 2/1988 | Zoludow | 200/81.9 R |

*Primary Examiner*—William M. Shoop, Jr.
*Assistant Examiner*—Paul Ip

[57] ABSTRACT

An improved structure of a fixed device of fan switch, which is to fix a fan switch fixing plate to the steering gear box that firmly attached to the motor and to fix a fan switch to the fixing plate through two of the supporting rods of the fixing plate, and at the same time, to fix a plastic back cover to the fixing plate through the other two supporting rods of the fixing plate so as to combine the motor, the fan switch fixing plate, the fan switch and the plastic back cover together as one unit.

1 Claim, 4 Drawing Sheets

STRUCTURE OF FIXED DEVICE OF FAN SWITCH

BACKGROUND OF THE INVENTION

Regular electric fans are usually equipped with a switching device, which device is normally fixed to a fan on stand seat as seen in regular desk fans, desk/stand fans of double-use, or on the neck of the fan stand (below the rotating part) as mostly seen in stand fans and desk/stand fans of double-use. The fan switch is for people to control power ON/OFF and motor shaft speed. In regular electric fans, the switching device is usually connected to the power source and the guide wire of the motor in a way that the connecting wire should penetrate through the casing of the motor and the casing of the stand of the fan. Because the casing of the motor is not adjacent to the casing of the stand of the fan, the connection of the power line is rather difficult and inconvenient. Moreover, while in production, the assembly of the fan should be made in a way that the motor assembly and the assembly of the stand of the fan should be separately arranged. For the reason said, the efficiency for the assembly of the conventional fans is limited and the cost of which is somewhat elevated.

In order to improve the efficiency and reduce the cost in assembling electric fans, the present invention has been created to provide a simple and fixed type fan switch which is easy for maintenance and can improve the problems existed in regular electric fans as described above.

SUMMARY OF THE INVENTION

The present invention relates to an improved structure of a fixed device of fan switch and more particularly a fixed type fan switch that is not fixed at the stand seat of the fan and that can facilitate the assembly of the fan.

The present invention is characterized in that the fixing plate of the switch is connected to the steering gear box at the rear end of the motor housing and the switching device is firmly fixed to the supporting rods of the fixing plate, and a plastic back cover is fixed to the other supporting rods of the fixing plate so as to make the motor housing, fixing plate, fan switch and plastic back cover be firmly fixed together to become an integrated unit to form a switching device of "triple fixing".

DETAILED DESCRIPTION OF THE INVENTION

Figure 1:
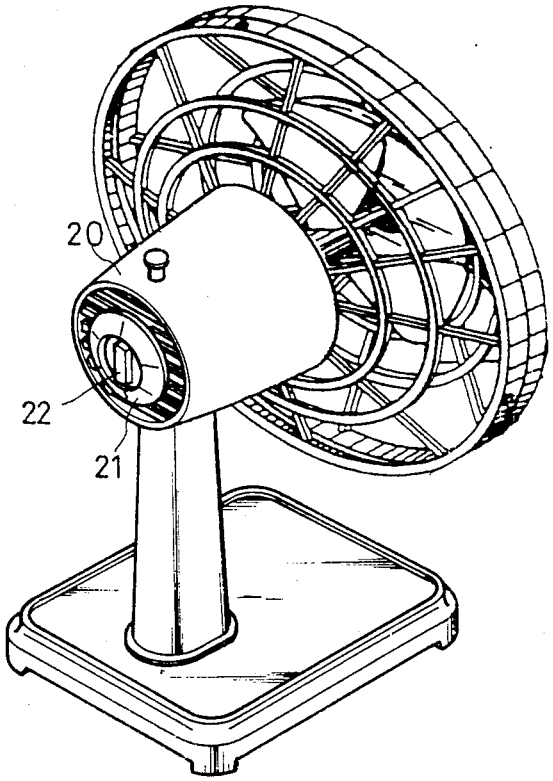
FIG. 1 is a drawing showing one preferred embodiment of the invention.
Figure 2:
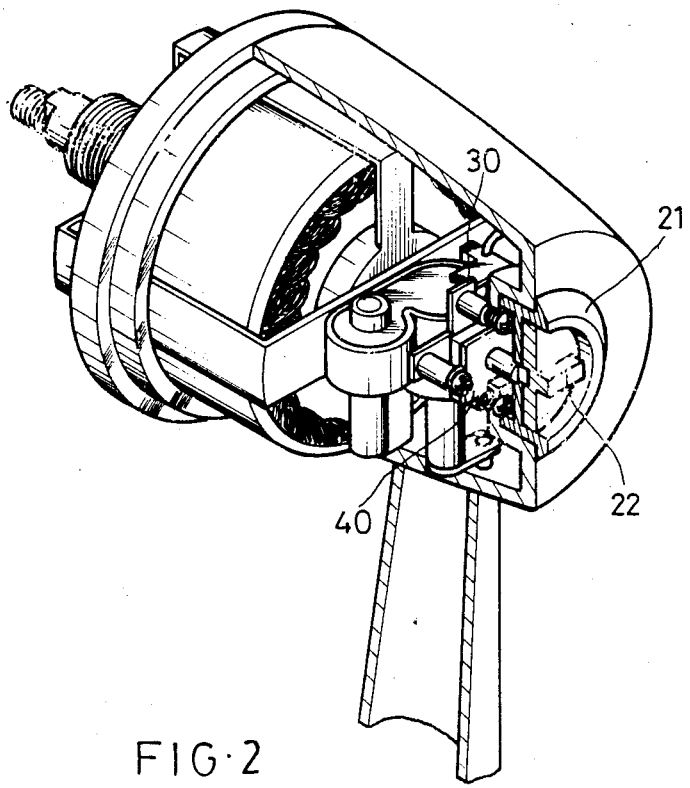
FIG. 2 is a sectional view of the preferred embodiment take in FIG. 1.
Figure 3:
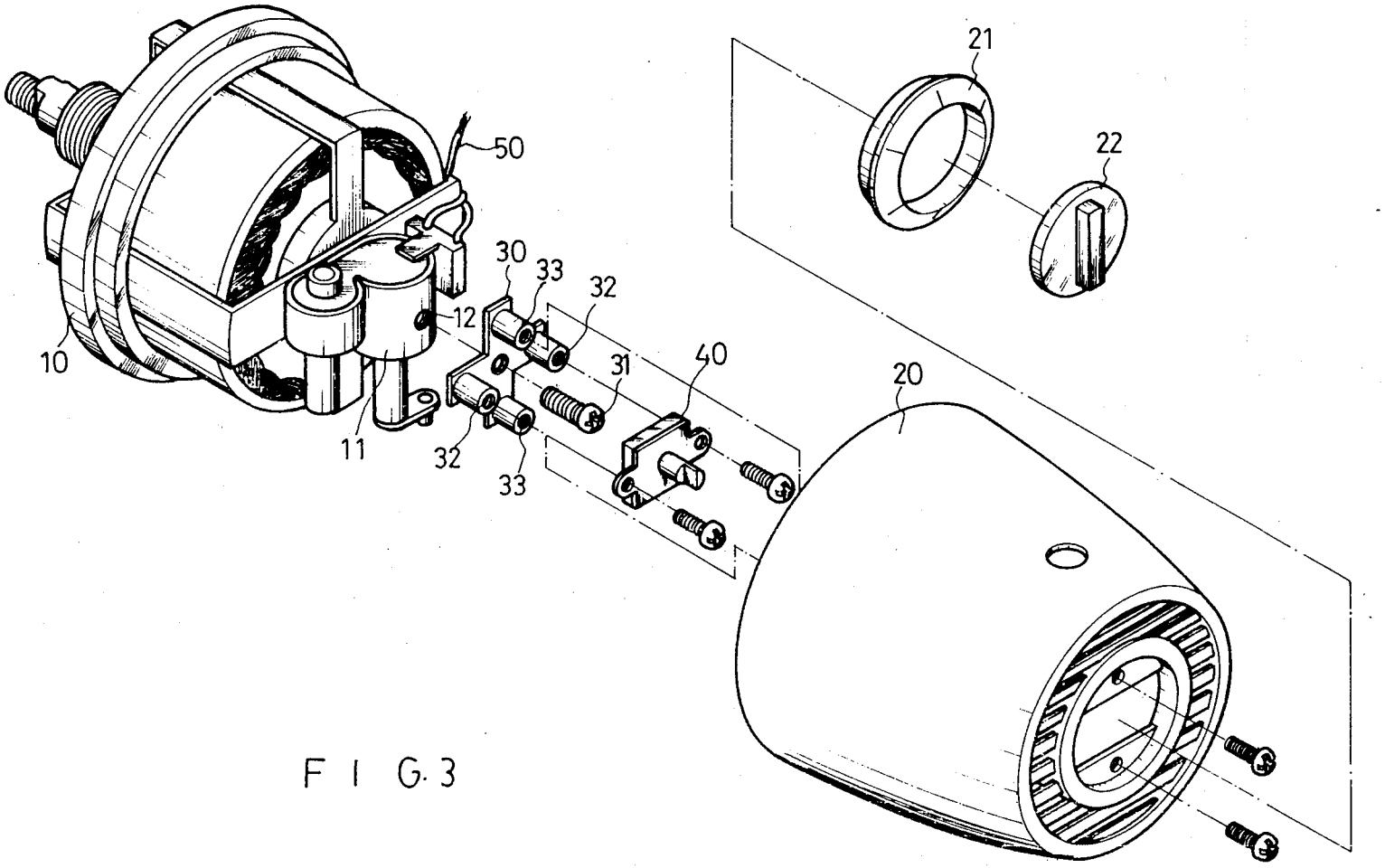
FIG. 3 is an assembly drawing of the preferred embodiment.
Figure 4:
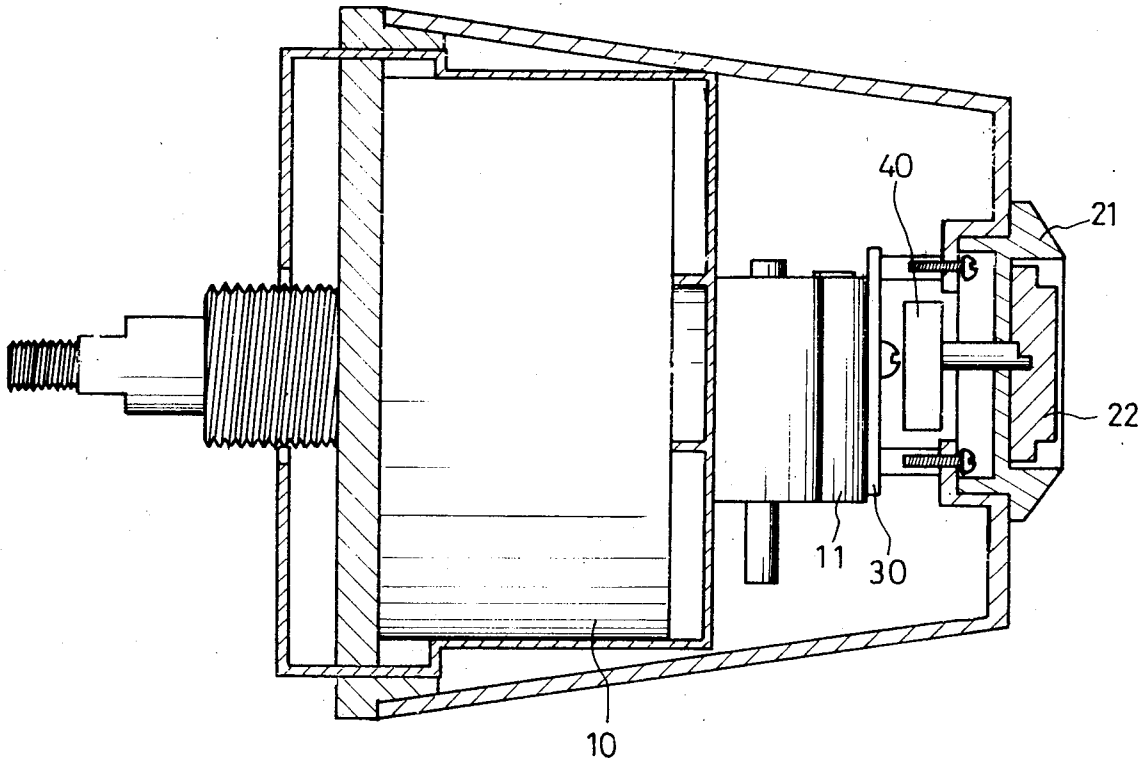
FIG. 4 is a vertically cross-sectional view of the preferred embodiment.

As shown in FIGS. 1 and 2, the fixed device of the fan switch of the present invention is an integrated part of the motor housing 10. As the assembly of the switching device is completed, a plastic back cover 20 is then attached to let the fixed device of fan switch be concealed there inside. When to turn on the power or the change the fan speed, it can be operated by means of an index dial 21 and a rotary switch arranged outside.

The steering gear box of the fan is firmly attached to the motor housing at the rear end, wherein the casing of the steering gear box has a fixing hole 12 for the fixation of the fixing plate 30 of the present invention.

The fixing plate 30 of the present invention is firmly fixed to the steering gear box 11 at the rear end of the motor housing 10 by means of a fixing bolt through said fixing hole 12 so as to let the fixing plate 30 and the steering gear box 11 be united as one integrated part. The fan switch 40 is then firmly fixed to the fixing plate 30 through the supporting rods 32. As the fan switch 40 is fixed, the motor guide wire 50 (tinfinished) that controls the motor speed (maximum, mediate, minimum) is then inserted into the said fan switch 40 letting it be connected with power line so as to complete the wiring. As soon as the wiring is completed, the plastic back cover 20 is then fixed to the fixing plate 30 by bolts through the other two supporting rods 33 of the fixing plate 30 so as to complete a "triple fixing" of the fan switch fixed device of the present invention to let it be convenient for maintenance.

As described above, the present invention provides a simple structure for easy assembly which is not easy for maintenance but also can reduce the manufacturing cost. However, what above described is the spirit of the invention, any modification or variation derived from the invention shall be included into the category of the patent solicited.

I claim:

1. An improved structure of a fixed device of fan switch, composed of a motor, fan switch fixing plate having at least four supporting rods, fan switch, plastic back cover, index dial, and rotating switch, characterized in that:

said fixing plate being fixed to a steering gear box at the rear end of the motor, said fan switch being fixed to the fixing plate by means of two of the supporting rods of the fixing plate, and said plastic back cover being fixed to the fixing plate through the other two supporting rods of the fixing plate in a position posterior to said fan switch so as to let the motor, the fixing plate, the fan switch and the plastic back cover be firmly fixed together as an integrated unit to complete the triple fixing of the fan switch fixed device to facilitate the assembly of the fan and the maintenance of the same.

* * * * *